US008074301B2

(12) United States Patent
Mothaffar

(10) Patent No.: US 8,074,301 B2
(45) Date of Patent: Dec. 13, 2011

(54) HEAD AND NECK RESTRAINT SYSTEM

(76) Inventor: Hussain Mothaffar, Al-Salmiya (KW)

( * ) Notice: Subject to any disclaimer, the term of this patent is extended or adjusted under 35 U.S.C. 154(b) by 365 days.

(21) Appl. No.: 12/402,905

(22) Filed: Mar. 12, 2009

(65) Prior Publication Data

US 2010/0229287 A1 Sep. 16, 2010

(51) Int. Cl.
*A41D 13/05* (2006.01)
*A42B 3/14* (2006.01)

(52) U.S. Cl. ..... 2/468; 2/421; 2/416; 2/415; 2/411

(58) Field of Classification Search ..... 2/421, 468, 2/425, 415, 416, 411; 280/801.1, 290
See application file for complete search history.

(56) References Cited

U.S. PATENT DOCUMENTS 3,278,230 A * 10/1966 Boyce et al. ..... 297/465
4,638,510 A * 1/1987 Hubbard ..... 2/6.1
4,923,147 A * 5/1990 Adams et al. ..... 244/122 AG
5,123,408 A * 6/1992 Gaines ..... 602/17
5,248,293 A * 9/1993 Hubbard et al. ..... 602/17
5,272,770 A * 12/1993 Allen et al. ..... 2/421
5,371,905 A * 12/1994 Keim ..... 2/413
5,517,699 A * 5/1996 Abraham, II ..... 2/425
5,915,787 A * 6/1999 Brookman ..... 297/256.13
6,006,368 A * 12/1999 Phillips ..... 2/468
6,009,566 A * 1/2000 Hubbard ..... 2/468
6,052,835 A * 4/2000 O'Shea ..... 2/468
6,308,345 B1 * 10/2001 Williams, Jr. ..... 2/468
6,588,022 B1 * 7/2003 Anders et al. ..... 2/421
6,751,809 B1 * 6/2004 Cooper et al. ..... 2/421
6,810,535 B1 * 11/2004 Moloney ..... 2/411
6,931,669 B2 * 8/2005 Ashline ..... 2/422
6,968,576 B2 * 11/2005 McNeil et al. ..... 2/425
7,380,290 B2 * 6/2008 Mothaffar ..... 2/421
7,395,558 B2 * 7/2008 Mothaffar ..... 2/421
2007/0067893 A1 * 3/2007 Mothaffar ..... 2/421
2007/0083987 A1 * 4/2007 Mothaffar ..... 2/468

* cited by examiner

*Primary Examiner* — Bobby Muromoto, Jr.
(74) *Attorney, Agent, or Firm* — Lowe Hauptman Ham & Berner LLP

(57) ABSTRACT

A restraint system for limiting the range of motion of an individual's head and flexure of their neck includes an arrangement of straps extending from a head engulfing helmet to a two piece arch-shaped shoulder mounted support member. The arch-shaped shoulder mounted support member includes a front portion, a rear portion and a mechanism for adjusting the curvature of the arch to accommodate individuals of different sizes and also to accommodate different seating positions. A pair of upwardly extending restraint members extends upwardly from the rear portion of the shoulder mounted support member. An upper portion of the upwardly extending restraint member extends upwardly behind the helmet and is tethered to the helmet so that the upwardly extending restraint member limits forward and rear movement of the head.

5 Claims, 14 Drawing Sheets

FIG. 18
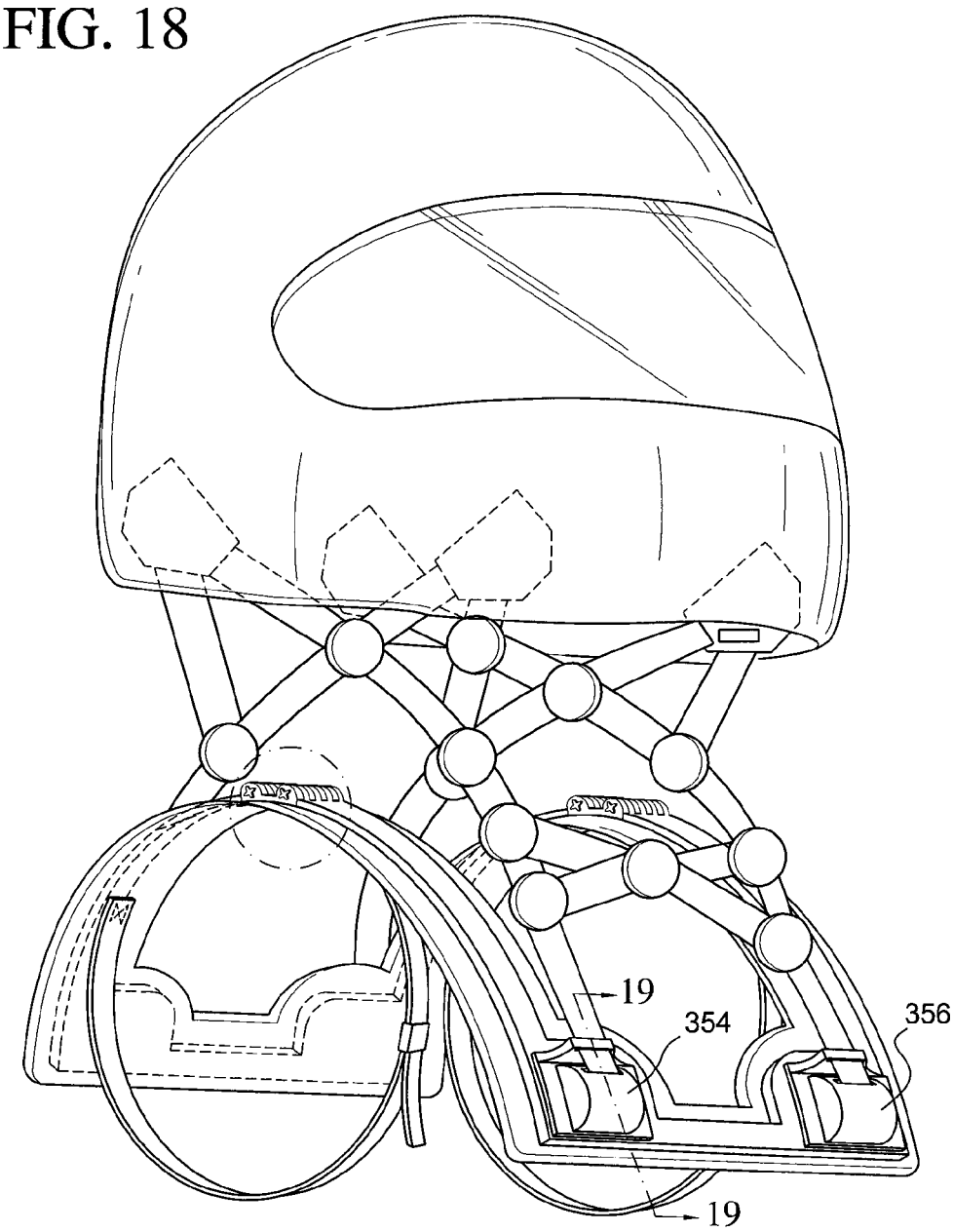
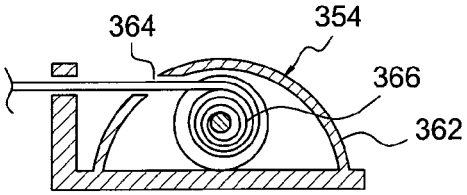
FIG. 19

368
370
372
382
384
384
374
376
378
380
386
386
388
388

HEAD AND NECK RESTRAINT SYSTEM

FIELD OF THE INVENTION

This invention relates a head and neck restraint system for protecting the neck of an individual during a crash of a motor vehicle and more particularly to an improved head and neck restraint system for restricting the forward/aft movement of a motorcycle rider's head in the event of an accident.

BACKGROUND FOR THE INVENTION

The use of crash helmets to protect the head of drivers of high speed race cars and motorcycles is well known. In fact the use of crash helmets is commonly accepted for riders of motorcycles. However, the use of a helmet does not limit the range of motion of the driver's neck and does not adequately protect the neck in the event of an accident particularly one of high speed.

For motorcycle racers there is one generally accepted approach for protecting the head and neck of competitors. For example, it is presently believed that a Hans device as disclosed in U.S. Pat. Nos. 6,810,535 and 6,813,782 are commonly used in racing motorcycles.

Two more recent approaches for a neck protector for use with a crash helmet are disclosed in my earlier U.S. Pat. Nos. 7,380,290 and 7,395,558 which are included herein in their entirety by reference. As disclosed therein, the head and neck restraint system includes a head enclosing crash helmet of the type having a head shell surrounding the head, forehead and chin of an individual with an opening in a bottom portion thereof and a face portion, a plurality of straps and means for releasably securing the plurality of straps to a portion of the helmet. The system also includes means for securing the plurality of straps to the individual and wherein the plurality of straps form an X-pattern configuration on the right and left sides of a user below the helmet.

Notwithstanding the above, it is presently believed that there is a need and a potentially commercial market for an improved head and neck restraint system in accordance with the present invention. There should be a need and a commercial market because it is believed that the restraint system in accordance with the present invention will reduce the risk of serious injury in a high speed crash at a competitive cost.

BRIEF SUMMARY OF THE INVENTION

In essence, a head and neck restraint system in accordance with the present invention includes:

a head enclosing helmet of the type having a head shell surrounding the head, forehead and chin of an individual with an opening in the bottom portion and a face portion;

an arch-shaped shoulder support member comprising a front half portion resting on and extending over a forward part of the individual's shoulders and an upper portion of the individual's chest, and a rear half portion resting or a rear portion of the individual's shoulders and extending over the rear portion of the individual's shoulders and an upper portion of the individual's back, and an adjusting mechanism for adjusting the curvature of the arc shaped shoulder support member and wherein said front half portion and said rear half portion are pivotally connected to the adjustment means.

The system also includes means at least partially passing under an individual's arm fixed to the front and rear half portions for maintaining the arch-shaped shoulder support member on the shoulders of an individual and a plurality of straps and means for securing the plurality of straps to a portion of the helmet.

In addition, the system includes means for releasably securing the plurality of straps to the arch-shaped shoulder member and wherein the plurality of straps form an X-pattern configuration on a right side and a left side of the individual below the helmet. Finally, the system includes a pair of adjustable upwardly extending restraint members that extend upwardly behind the head of an individual and a pair of tethers or straps connecting the helmet to the upwardly extending restraint members to thereby prevent excessive forward movement of the head in the event of an accident. The upwardly extending restraint members also prevent or limit rearward movement of the head during an accident.

In an preferred embodiment of the invention a head shell surrounds the head, forehead and chin of an individual with an open bottom portion, a face portion and a forward and forward lower and rear lower connecting points on each side thereof. An arch-shaped shoulder mounted support member comprises a front portion resting on and extending over a forward part of the individual's shoulders and upper portion of the individual's chest and a rear portion resting on a rear part of the individual's shoulders and an upper portion of the individual's back. An adjustable mechanism for adjusting the curvature arch-shaped shoulder mounted support member and wherein said front portion and said rear portion of said arch-shaped shoulder mounted support member are pivotally connected. Means are passing over at least partially under the individual's arms are fixed to the arch-shaped shoulder mounted support member for maintaining the arch-shaped shoulder mounted support member on the shoulders of the individual.

In a preferred embodiment of the invention first and second flexible connecting members connect the forward lower and rear lower connecting points on each side of the head shell to the front portion and rear portion of the arch-shaped shoulder mounted support member and wherein each of the flexible connecting means form an X-pattern configuration on the right side and the left side of the individual below the helmet.

A pair of adjustable upwardly extending restraint members that extend upwardly behind the head of the individual and third and fourth flexible connecting means with one of said flexible connecting means connecting an upper side of said head shell to one of said upwardly extending restraint members and the other of said third and fourth flexible connecting means connecting an upward side of the other side of said head shell to the other of said upwardly extending restraint members whereby the upwardly extending restraint member prevents forward movement of the individual's head as a result of a crash and wherein the upwardly extending restraint member also limit rearward movement of the individual's head to prevent whiplash or other injury.

The invention will now be described in accordance with the following figures wherein like numbers have been used to illustrate like parts.

DESCRIPTION OF THE DRAWINGS

These and other objects of the present invention will be appreciated and understood by those skilled in the art from the detailed description of the preferred embodiments of the invention and the following drawings of which:

FIG. 18 is a perspective view of a neck restraint system in accordance with my earlier patents and which is applicable to the present invention;

FIG. 19 is a side sectional view of a strap retaining means of the system shown in FIG. 18;

DETAILED DESCRIPTION OF THE INVENTION

Figure 1:
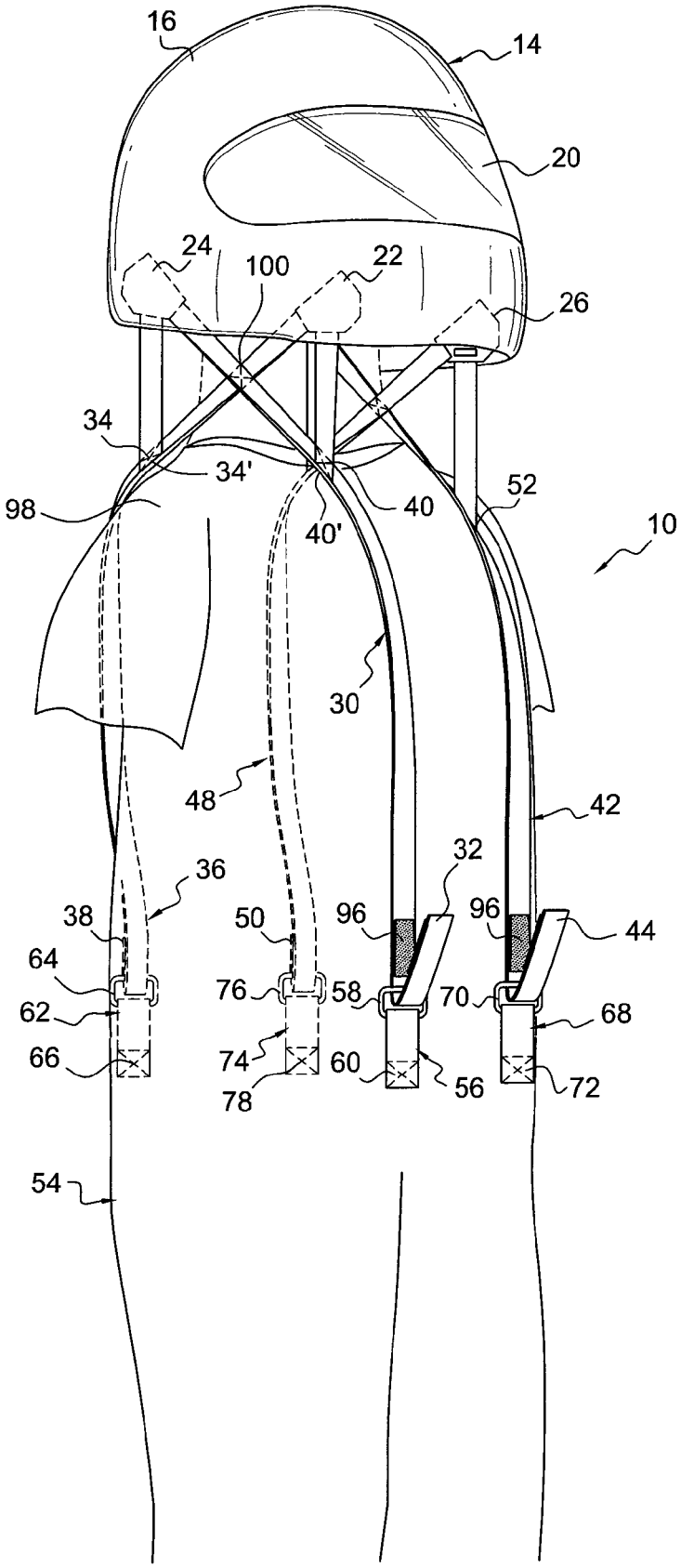
FIG. 1 PRIOR ART
FIG. 1 is a perspective view of the preferred embodiment of the neck restraint system according to my earlier U.S. Pat. Nos. 7,380,290 and 7,395,558 in an assembled configuration attached to a helmet on an individual.
Figure 3:
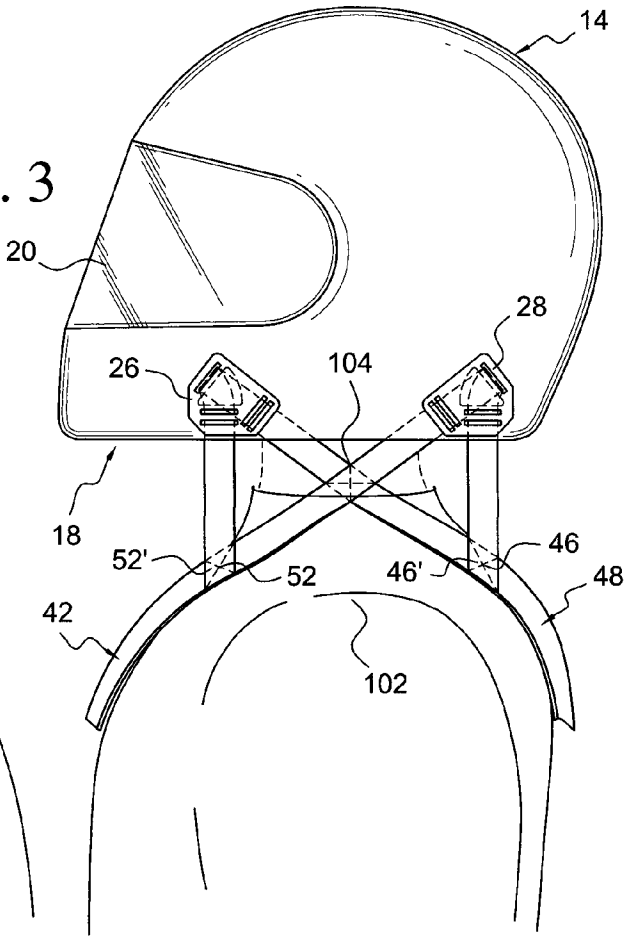
FIG. 3 is a left side elevation view of the neck restraint system of FIG. 1.
Figure 2:
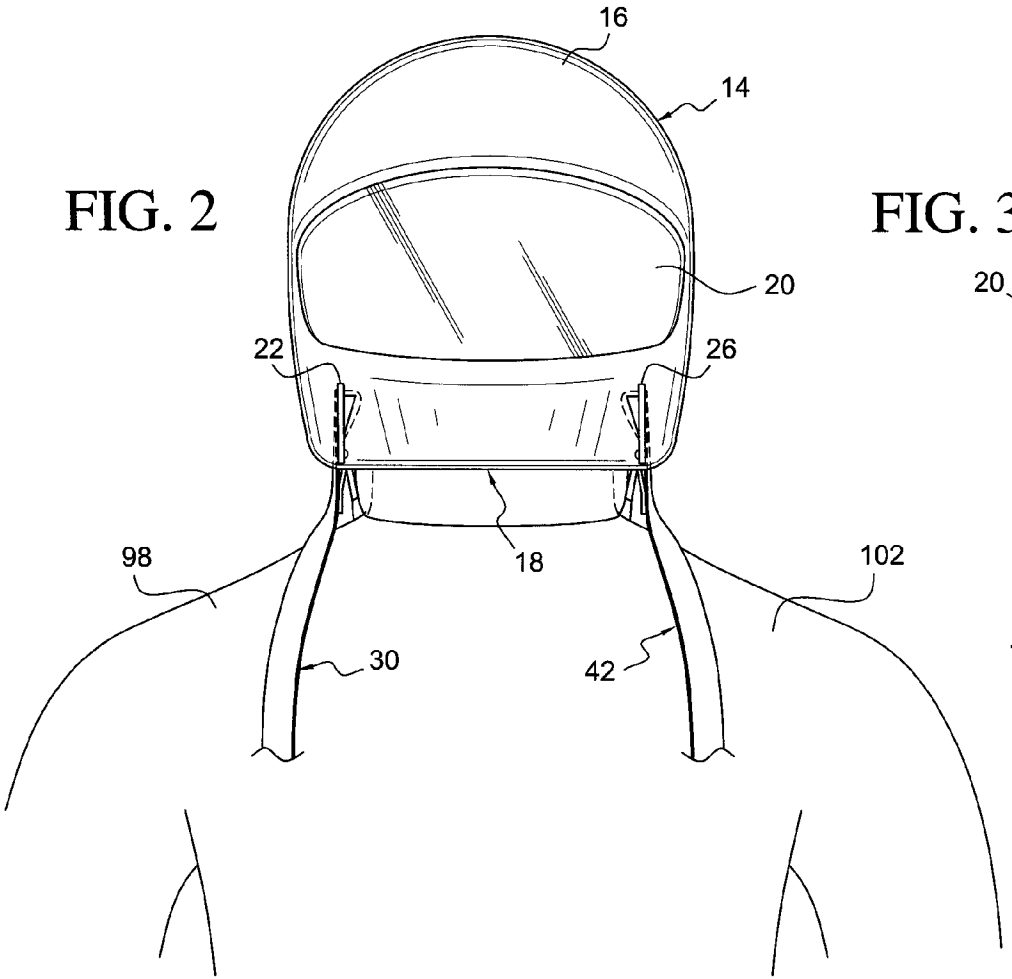
FIG. 2 is a front elevation view of the neck restraint system of FIG. 1.
Figure 4:
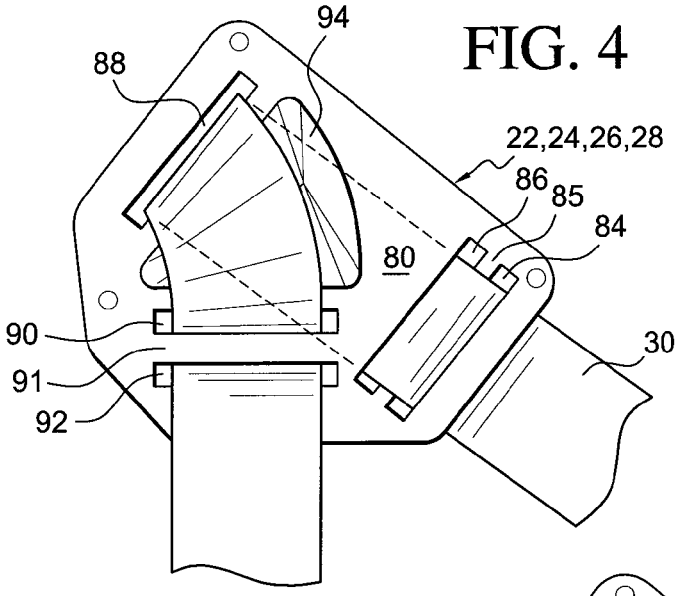
FIG. 4 is top plan view of a directive anchor as used for securing the straps of the neck restraint system to the helmet as disclosed in my earlier patents and which may be used in the present invention.
Figure 5:
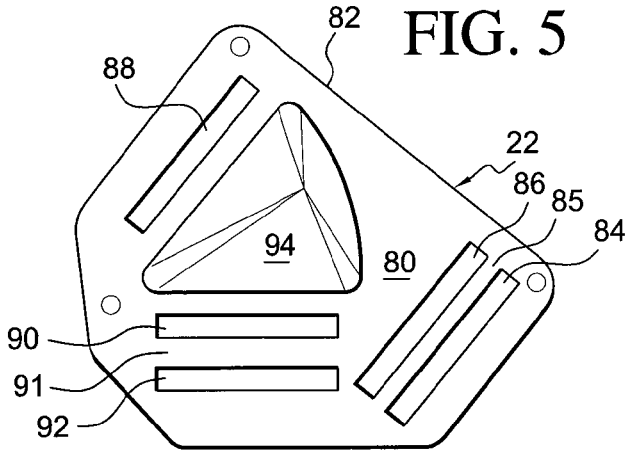
FIG. 5 is the top plan view of the strap directive anchor of FIG. 4 in a non-use configuration as disclosed in my earlier patent and which may be used in the practice of the present invention.
Figure 6:
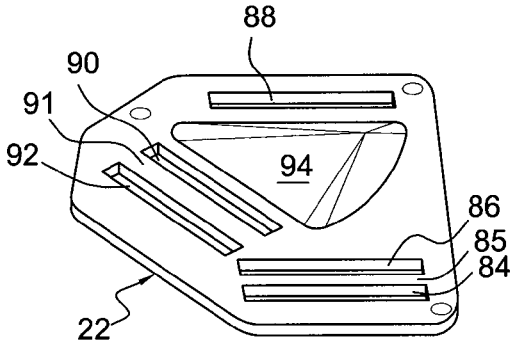
FIG. 6 is a side perspective of the strap directive anchor of FIG. 4 in a non-use configuration as disclosed in my earlier patent and which may be used in the practice of the present invention.
Figure 7:
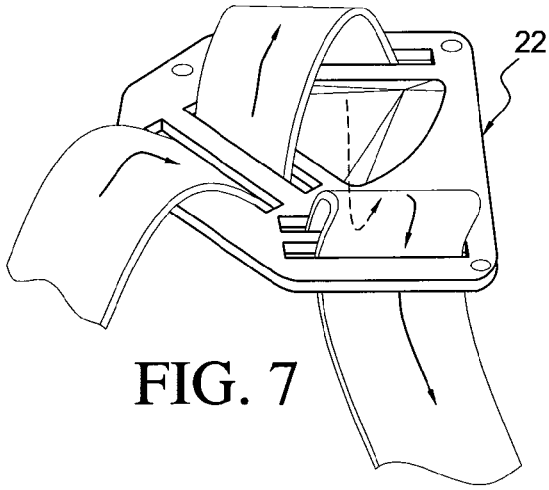
FIG. 7 is a perspective view of the strap directive anchor of FIG. 4 illustrating the way the straps are directed and attached thereto as disclosed in my earlier patent and which may be used in the practice of the present invention.

Referring now to the drawings, wherein the showings are for the purpose of illustrating the preferred embodiments of the invention only and not for the purpose of limiting the same, referring to FIGS. 1-3, a prior art neck restraint system in accordance with my earlier patents is generally shown at 10 being used by a user 12 and attached to a crash helmet 14. The helmet 14 includes a head shell 16 and a bottom opening 18 for providing access for the user's head, and a frontal opening 20 to provide visibility for the user when the user has the helmet on.

In the first representative embodiment of my earlier invention, the neck restraint system 10 comprises a plurality of laterally symmetrical straps that are attached to the helmet 14 at one end and are removably attached to the user's outfit at opposing second end.

The neck restraint system 10 comprises a plurality of directive anchors and, more specifically and preferably, four directive anchors wherein a first directive anchor 22 is attached to an inner and frontal right side of the helmet shell 16, a second directive anchor 24 is attached to the inner and rear right side of the helmet shell 16, a third directive anchor 26 is attached to the inner and frontal left side of the helmet shell 16, and a fourth directive anchor 28 is attached to the inner and rear left side of the helmet shell 16. The first and the second directive anchors 22, 24 are preferably symmetrically positioned with respect to the third and fourth directive anchors 26, 28. Also, the number of the directive anchors are not limited to four and, alternatively, they may be positioned and attached to the outside of the helmet shell 16. The first, second, third, and fourth directive anchors 22, 24, 26, 28 preferably have identical shapes and configurations, as best seen FIGS. 4-7, and provide an attaching means for securing the plurality of straps of the neck restraint system to the helmet.

The neck restraint system 10 further includes a first strap or belt 30, preferably made of nylon, polyester, cotton, or combinations thereof, having a first end 32 and a second end 34, a second strap 36 having a first end 38 and a second end 40, a third strap 42 having a first end 44 and a second end 46, and a fourth strap 48 having a first end 50 and a second end 52, configured and attached to one another in a manner that will be explained in a greater detail herein.

As best seen in FIG. 1, the neck restraint system 10 is attached to a user's outfit or race suit, generally illustrated at 54. A plurality of anchor straps are attached at the outer portion of the user's race suit 54 generally below the user's abdomen area. More specifically, a first anchor strap 56 having a first metal loop 58 is attached to a first end thereof, and a second end 60 is attached, preferably, but not limited to, by stitching to the front side outer portion of the race suit 54. A second anchor strap 62 having a second metal loop 64 is attached to a first end thereof, and a second end 66 is attached by, preferably, but not limited to, stitching to the rear side outer portion of the race suit 54. A third anchor strap 68 having a third metal loop 70 is attached to a first end thereof, and a second end 72 is attached by, preferably, but not limited to, stitching to the front side outer portion of the race suit 54. And a fourth anchor strap 74 having a fourth metal loop 76 is attached to a first end thereof, and a second end 78 attached by, preferably, but not limited to, stitching to the rear side outer portion of the race suit 54. As will be explained herein, the first, second, third, and fourth anchor straps 56, 62, 68, and 74 are laterally and symmetrically positioned and attached to the race suit for providing support for the first, second, third, and fourth straps 30, 36, 42 and 48, respectively.

Referring to FIGS. 4 through 7, the first directive anchor 22 is illustrated. As stated hereinabove, the first, second, third and fourth directive anchors 22, 24, 26, and 28 are preferably identical in shape and configuration, and therefore, the structural features and the fastening means of each directive anchor is described and illustrated in view of the first directive anchor 22 only. The first directive anchor 22 includes a top surface 80, a bottom surface 82 and a plurality of elongate slots providing a plurality of openings from the top surface 80 to the bottom surface 82. More specifically, the first directive anchor 22 includes a first slot 84 and a second parallel slot 86 disposed at one side thereof and separated from the first slot 84 by a first divider 85, a third slot 88 is substantially parallel to the first and the second slots 84, 86, and a fourth slot 90 and a fifth slot 92 are separated from the fourth slot 90 by a second divider 91 and parallel to the fourth slot 90 at a second side of the first directive anchor and substantially below the first, the second, and third slot 84, 86, 88. The first directive anchor 22 further includes a pyramid-configured protrusion 94 on the top surface 80 and is positioned and bounded by the second slot 86, third slot 88, and the fourth slot 90, wherein, as will be explained in greater detail, the straps of the neck restraint system are extended over the pyramid-configured protrusion 94.

Referring now to FIGS. 1 through 7, the assembled neck restraint system 10 will be explained. In order to attach the neck restraint system 10 to the helmet 14 and the race suit 54 of the user, the first strap 30 is attached to the second directive anchor 24 by extending the first strap second end 34, or in the alternative, the first strap first end 32, through the first slot 84 from underneath, then over the first divider 85, through the second slot 86 and underneath the second directive anchor 24, up through the third slot 88 and over the pyramid-configured protrusion 94 and through the fourth slot 90, underneath the second divider 91, and then up through the fifth slot 92. The first strap second end 34 is then attached by, preferably, but not limited to, stitching to an upper portion of the second strap 36 at 34'. Now, the first strap first end 32 is of a length and dimensioned and configured to extend and be inserted through the first metal loop 58 attached to the first anchor strap 56, and folder over and secured to itself by a fastening means, such as, but not limited to, a VELCRO brand fastening means 96.

The second strap 36 is slidably disposed within or attached to the first directive anchor 22 in a substantially similar manner as the first strap 30 being attached to the second directive anchor 24, wherein the second strap second end 40 is attached, preferably by stitching to the first strap 30 at 40' and just above the user's right shoulder 98, and the second strap first end 38 extends through the second anchor strap second metal loop 64 and is folded and secured to itself by a VELCRO brand hook and loop fastening means 96.

The substantially mid-point of the portion of the first strap 30 between where the second strap first end 40 is attached or stitched to the first strap 30 at 40' and the second directive anchor 24 is also stitched and attached at a point 100 to substantially the mid-point of the portion of the second strap 36 between where the first strap second end 34 is attached to stitched to second strap 36 at 34' and the first directive anchor 22. Therefore, as best seen in FIG. 1, the right side of the neck restraint system 10 in the assembled configuration and right above the right shoulder 98 of the user includes an X-pattern configuration resulting from the portions of the first strap 30 and the second strap 36 being attached to the helmet.

As best seen in FIGS. 1 and 3, the third strap 42 is slidably disposed within or attached to the fourth directive anchor 28 in a substantially similar manner as the first strap 30 being attached to the second directive anchor 24, wherein the third strap second end 46 is attached, preferably by stitching to the fourth strap 48 at 46' just above the user's left shoulder 102, and the third strap first end 44 extends through the third metal loop 70 and is folded and secured to itself by a VELCRO brand fastening means 96. Similarly, the fourth strap 48 is slidably disposed within or attached to the third directive anchor 26 as the first strap 30 being attached to the second directive anchor 24, wherein the fourth strap second end second end 52 is attached, preferably by stitching to the third strap 42 at 52' just above the user's left shoulder 102, and the fourth strap first end 50 extends through the fourth anchor strap metal loop 76 and is folded and secured to itself by a VELCRO fastening means 96. Alternatively, other fastening means may be used instead of the VELCRO fastening means 96 such as, but not limited to, a belt and buckle securing means.

The substantially mid-point of the portion of the fourth strap 48 between where the third strap second end 46 is attached or stitched to the first strap 30 at 46' and the third directive anchor 26 is also stitched and attached at a point 104 to substantially the mid-point of the portion of the third strap 42 between where the fourth strap second end 52 is attached and stitched to third strap 42 at 52' and the fourth directive anchor 28.

Therefore, as best seen in FIG. 3, the left side of the neck restraint system 10 in the assembled configuration and above the left shoulder 102 of the user includes an X-pattern configuration resulting from the portions of the fourth strap 48 and third strap 42 being attached to the helmet.

Figure 8:
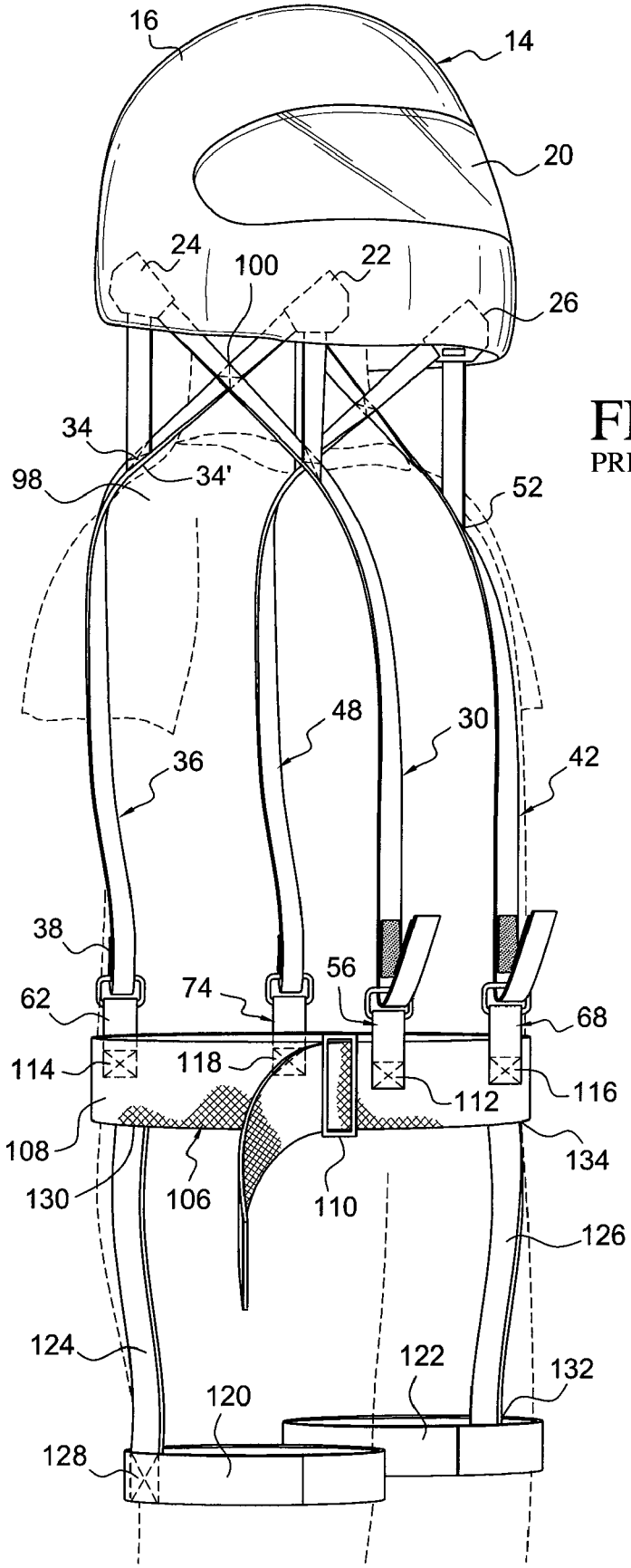
FIG. 8 PRIOR ART
FIG. 8 is a perspective view of the neck restraint system including a body attachment harness in accordance with one of my earlier patents.

Referring now to FIG. 8, a second representative embodiment of the neck restraint system is illustrated wherein the first, second, third, and fourth, 30, 36, 42, and 48 straps are attached to a harness assembly 106 instead of being directly attached to the user's race outfit. The harness assembly 106 comprises a main belt portion 108 having a buckle 110 which can be adjustably worn by the user around the user's waist. The first anchor strap 56 is now attached, preferably by stitching, to the main belt 108 at a second end 112, and similarly, the second anchor strap 62 is attached to the main belt 108 at a second end 114, the third anchor strap 68 is attached to the main belt 108 at a second end 116, and the fourth anchor strap 74 is attached to the main belt at a second end 118.

The harness assembly 108 further includes a leg attachment means comprising a right leg strap 120 dimensioned and configured to be wrapped around the user's right leg, preferably around the user's right thigh and above the right knee, and removably secured by an attaching means such as, but not limited to, a VELCRO brand fastener.

A right leg extension 124 includes a first end 128 securely attached to the right leg strap 120 preferably by stitching, and a second end 130 attached to a lower portion or the inside of the main belt 108. A left leg strap 122 dimensioned and configured to be wrapped around the user's left leg, preferably around the user's left thigh and above the left knee, and removably secured by an attaching means such as a VELCRO brand fastener. A left leg extension 126 includes a first end 132 securely attached to the left leg strap 122 preferably by stitching, and a second end 134 attached to a lower portion or the inside of the main belt 108.

Figure 9:
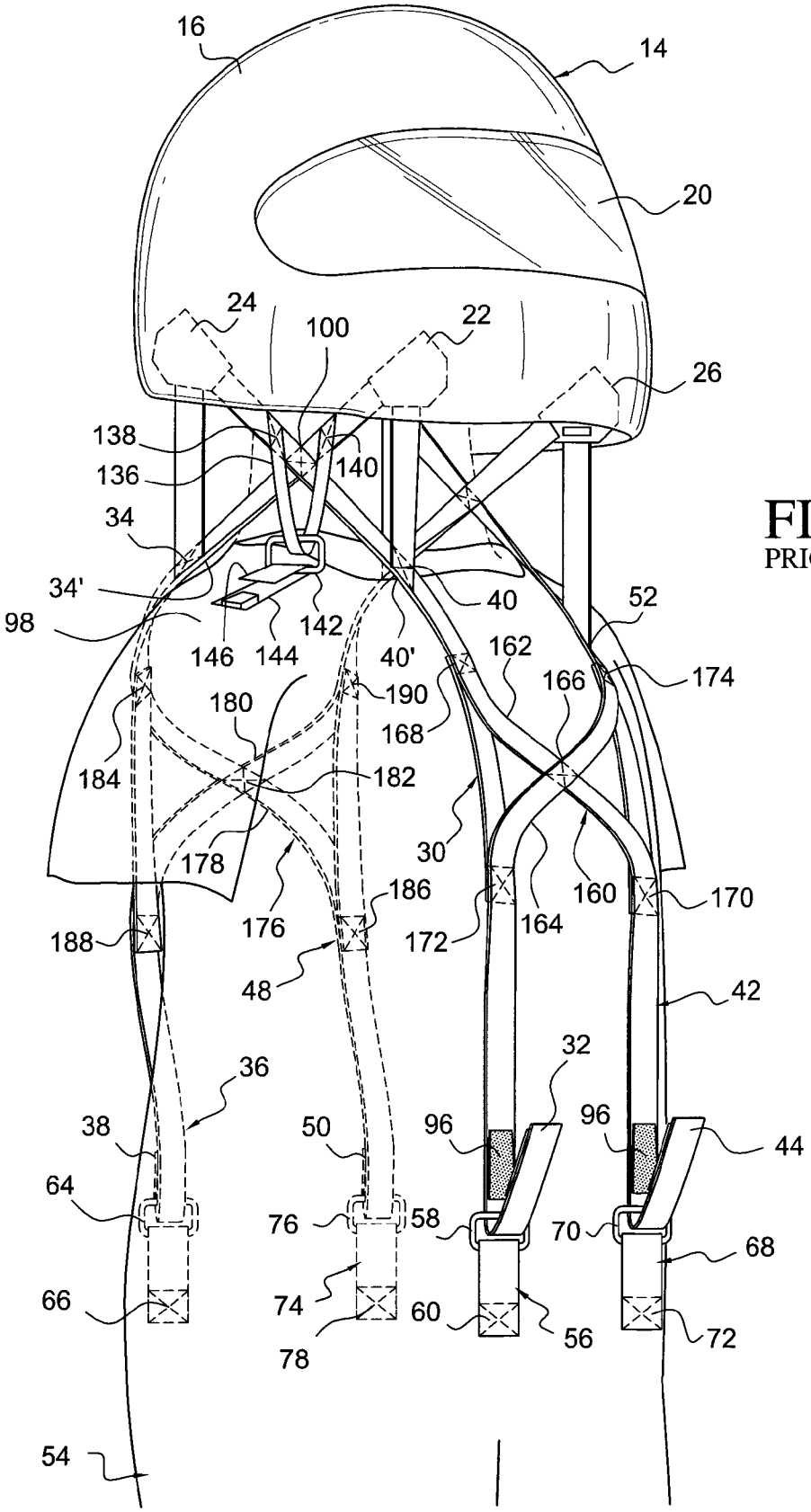
FIG. 9 PRIOR ART
FIG. 9 is a perspective view of a third representative embodiment of the neck restraint system in accordance with my earlier patents in an assembled configuration attached to a helmet on an individual.
Figure 11:
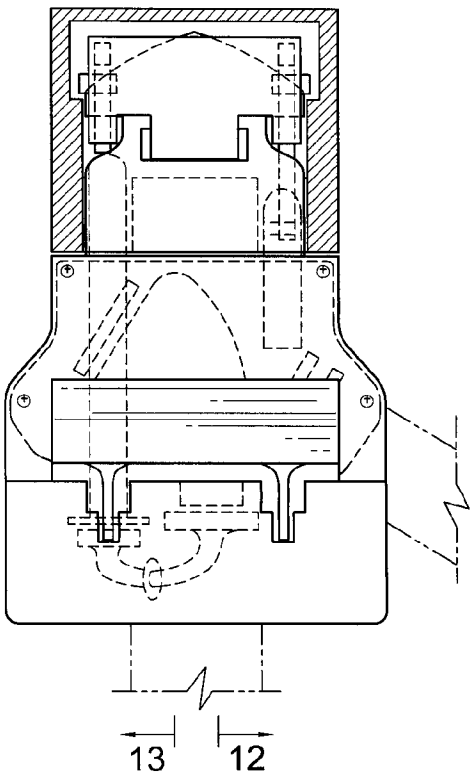
FIG. 11 is a side elevation view of a removable locking mechanism as disclosed in my earlier patents and which may be used in the practice of the present invention.
Figure 10:
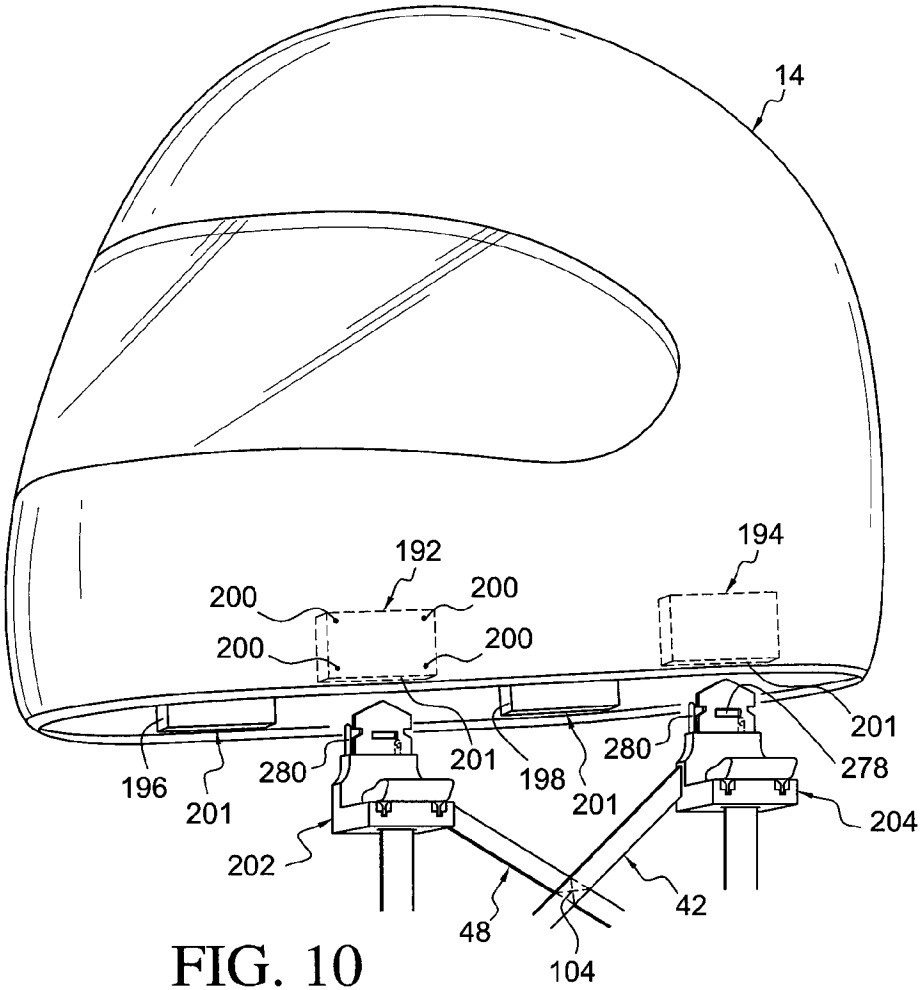
FIG. 10 is left side elevation view of the neck restraint system in accordance with a fourth representative embodiment of my previous invention.

Referring now to FIG. 9, a third approach for the neck restraint system 10 is illustrated. A fifth strap 136 having a first end 138 and a second end 140 provides further stability and securement of the system when in use by having the first end 138 attached, preferably by stitching, to the first strap 30 right above the point 100 and the second end 140 similarly attached to the second strap 36 right above the point 100. The fifth strap 136 also includes a metal loop 142 which is freely slidable between the first and the second ends 138, 140.

A fifth anchor strap 144 is attached, preferably by stitching, to the user's race outfit right above the right shoulder 98, wherein the fifth anchor straps's free end 146 can loop through the metal loop 142 and secure the fifth strap 136 by having the free end 146 attached to the opposing end of the fifth anchor strap 144 by means of VELCRO or other suitable removable means.

Similarly, for the left side of the neck restraint system, a sixth strap 148 having a first end 150 and a second end 152 provides further stability and securement of the system when in use by having the first end 150 attached, preferably by stitching, to the third strap 42 right above the point 104 and the second end similarly attached to the fourth strap 48 right above the point 104. The sixth strap 136 also includes a metal loop 154 which is freely slidable between the first and the second ends 150, 152.

A sixth anchor strap 156 is attached, preferably by stitching, to the user's race outfit right above the left shoulder 102, wherein the sixth anchor straps's free end 158 can loop through the metal loop 154 and secure the sixth strap 148 by having the free end 158 attached to the opposing end of the sixth anchor strap 156 by means of VELCRO or other suitable removable means.

Moreover, additional X-pattern straps may be attached to the front and the back of the neck restraint system 10 to limit the rotational and circular movement of the user's helmet while in use. More specifically, a front X-pattern strap 160 includes a strap 162 and a strap 164 attached in the middle at 166, wherein, as best seen FIG. 9, the first and the second ends of the strap 162 are attached to the first strap 30 and the third strap 42 at 168 and 170, respectively, and the first and the second ends of the strap 164 are attached to the first strap 30 and the third strap 42 at 172 and 174, respectively.

Similarly, a rear X-pattern strap 176 includes a strap 178 and a strap 180 attached in the middle at 182, wherein, as best seen FIG. 9, the first and the second ends of the strap 178 are attached to the second strap 36 and the fourth strap 48 at 184 and 186, respectively, and the first and the second ends of the strap 180 are attached to the second strap 36 and the fourth strap 48 at 188 and 190, respectively.

Referring now to FIGS. 10 through 14, a fourth alternative embodiment of the neck restraint system 10 is illustrated. More specifically, this embodiment contemplates the use of a removable mechanism for attaching and detaching the neck restraint system 10 from the user's helmet 14.

A plurality of female anchor receivers are attached to the inner front and rear sides of the helmet. More specifically, a first female anchor receiver 192 and a second female anchor receiver 194 is attached to the inner front left side and inner rear left side of the helmet 14 by means of, but not limited to, a plurality of screws 200. Similarly, a third female anchor receiver 196 and a fourth female anchor receiver 198 is attached to inner front right side and inner rear right side of the helmet 14 by means of, but not limited to, the plurality of screws 200. These female anchor receivers replace the first, second, third, and fourth directive anchors to provide for a detachable and removable assembly of the neck restraint system for the helmet.

Each of the first, second, third, and fourth female anchor receivers 192, 194, 196, and 198 includes a bottom opening 201 to provide, as will be explained herein, access for the detachable male anchors.

A plurality of male anchors, and more specifically, a first, second, third, and fourth male anchors 202, 204, 206, and 208 are provided to replace the first, second, third, and fourth directive anchors to attach the straps, and the first, second, third, and fourth male anchors, 202, 204, 206, and 208 are detachably attached to the first, second, third, and fourth female anchor receivers 192, 194, 196, and 198, respectively, in a manner that will be discussed in a greater detail below. It is noted that the first, the second, third, and fourth male anchors 202, 204, 206, and 208 are preferably identical to one another and, therefore, their details will be only discussed in relation to the first male anchor 202.

Figure 13:
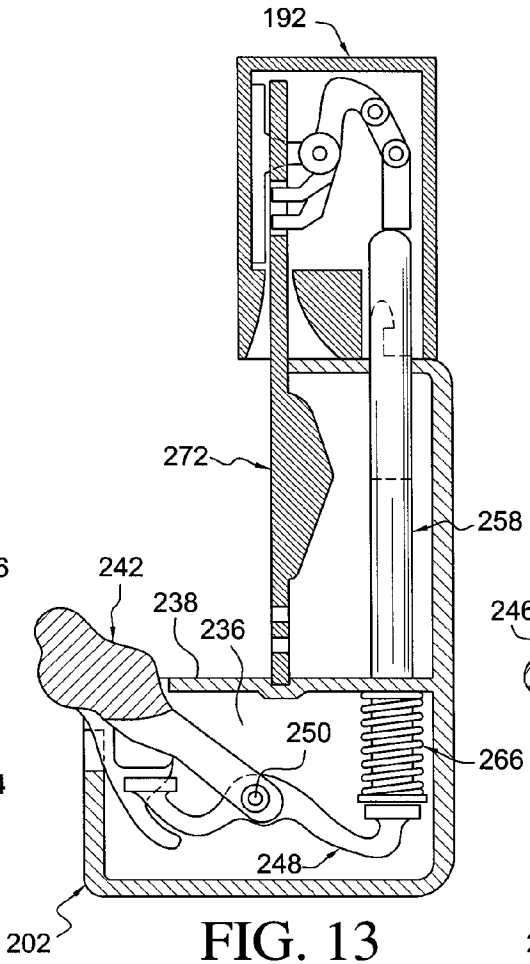
FIG. 13 is a cross-sectional view of FIG. 11 taken along the line 13-13.
Figure 12:
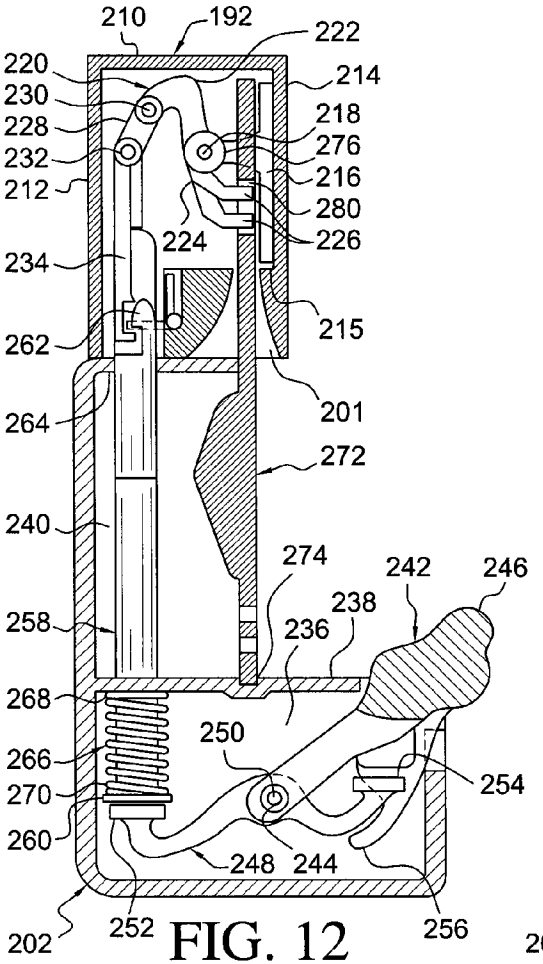
FIG. 12 is a cross-sectional view of FIG. 11 taken along the line 12-12.

Referring now to FIGS. 12 and 13, the first female anchor receiver 192 includes a top wall 210, a first sidewall 212, and a second sidewall 214 bounding the bottom opening 201. A support plate 216, preferably made from metal or other suitable material, is secured to the inner surface of the second sidewall 214 and further includes an extension arm having a circular pivot end 218. The second sidewall 214 further includes a protrusion 215 on the inner side thereof for providing further support to hold the support plate 216.

A hook-shaped linkage arm 220 includes a first portion 222 and a second portion 224 integral with the first portion 224, wherein the second portion 224 further includes a fork-shaped end having a pair of tines 226. The linkage arm 220 is pivotally attached to the support plate 216 at the circular pivot end 218 in a pivoting and balanced way, wherein the linkage arm 220, as best seen in FIG. 12, can pivot about the pivot end 218 in either a clockwise direction or a counter clockwise direction.

A second linkage arm 228 includes a first end and is pivotally attached to a second end of the first portion 222 of the hook-shaped linkage arm 220 at 230, and a second end 232 pivotally attached to a third linkage arm 234.

Referring to FIG. 12, the first male anchor 202 is illustrated in a locked, engaged, or attached configuration with the first female anchor receiver 192. The first male anchor 202 includes a lower housing 236 having a top wall 238 and an upper housing 240 on top of the lower housing 236. An actuating lever arm 242 is pivotally mounted within the lower housing 236 at one end through a pin or dowel 244 extending laterally the width of the lower housing 236, and further includes a second end 246 extending outwardly from the lower housing 236 and through the top wall 238 to provide support for a user's finger to actuate the mechanism.

A fourth linkage arm 248 is operably disposed within the lower housing and has a substantially W-shaped or wavy configuration. The fourth linkage arm 248 is centrally and pivotally mounted at a mid-point section 250 thereof through the pin or dowel 244 and includes a first engaging end 252 and an opposing second engaging end 254. The actuating lever arm 242 further includes an extension 256 which engages the lower portion of the second engaging end 254 as well as an upper portion of the second engaging end 254, wherein pressing the second end 246 of the actuating lever arm 242 would actuate the fourth linkage arm 248.

A plunger 258 includes a first end 260 and a second end 262 and slidably extends through the upper housing 240, wherein the second end 262 extends through an opening at a top wall 264 and engages the lower portion of the third linkage arm 234 through the opening 201. The first end 260 extends through an opening at the top wall 238 of the lower housing 236 and rests against the first engaging end 252 of the fourth linkage arm 248.

A coiled spring 266 is inserted through the first end 260 of the plunger 258, and includes a first end 268 resting against the lower surface of the top wall 238, and a second end 270 resting against the first engaging end 252 and providing a spring biased forced against the movement of the fourth linkage arm 248.

A directive anchor 272, similar to that of the directive anchors of the first embodiment for supporting the belt straps, includes a first end 274 attached to the upper surface of the top wall 238, and further includes a second engaging end having an arrow-head shape and configuration 276 with a laterally extending slit 278 therethrough. The arrow-head end 276 comprises a pair of opposing indentations 280 that provide for an engagement with the corresponding pair of tines 226 for the fork-shaped second portion 224.

Figure 14:
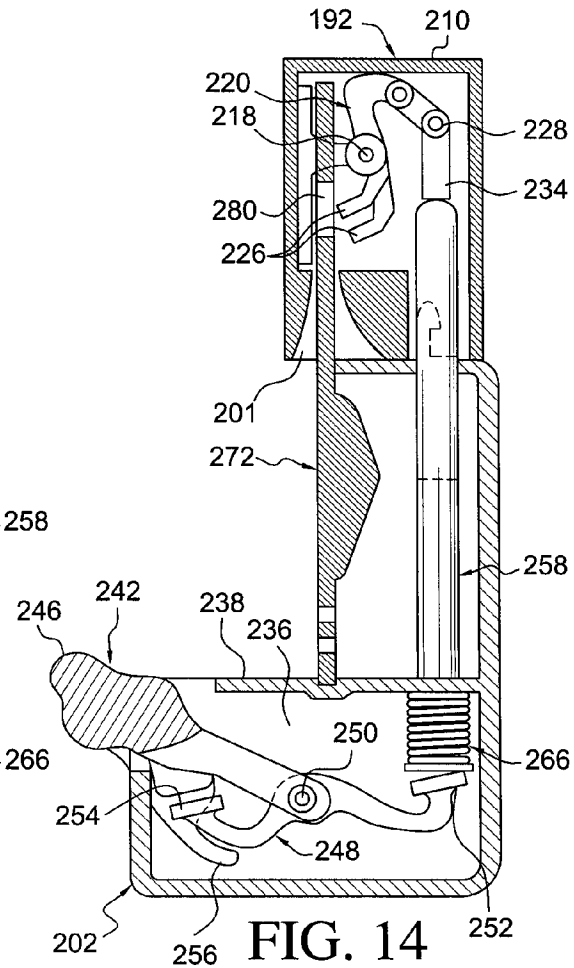
FIG. 14 is a cross-sectional view of the locking mechanism in a disengaged, unlocked, or released configuration.

Referring to FIG. 14, to disengage the first male anchor 202 from the first female anchor receiver 192, and thereby releasing the neck restraint system 10 from the user's helmet 14, a user presses the actuating lever arm 242 at the second end 246, causing the actuating lever arm 242 to pivot about the central pivot point 250, and further pivoting the fourth linkage arm 248 by pressing against the second engaging end 254. The first engaging end 253 presses against the first end 260 of the plunger 258, and compresses the coiled spring 266. The plunger 258 is moved upwardly and cause the third linkage arm 234 to move, and in turn causing the second linkage arm 228 to pivot, thereby causing the hook-shaped linkage arm 220 to pivot about the circular pivot end 218, which in turn cause the pair of tine 226 to move away and disengage the pair of indentations 280. Hence, the first male anchor 202 can be pulled down and away from the first female anchor 192.

Figure 15:
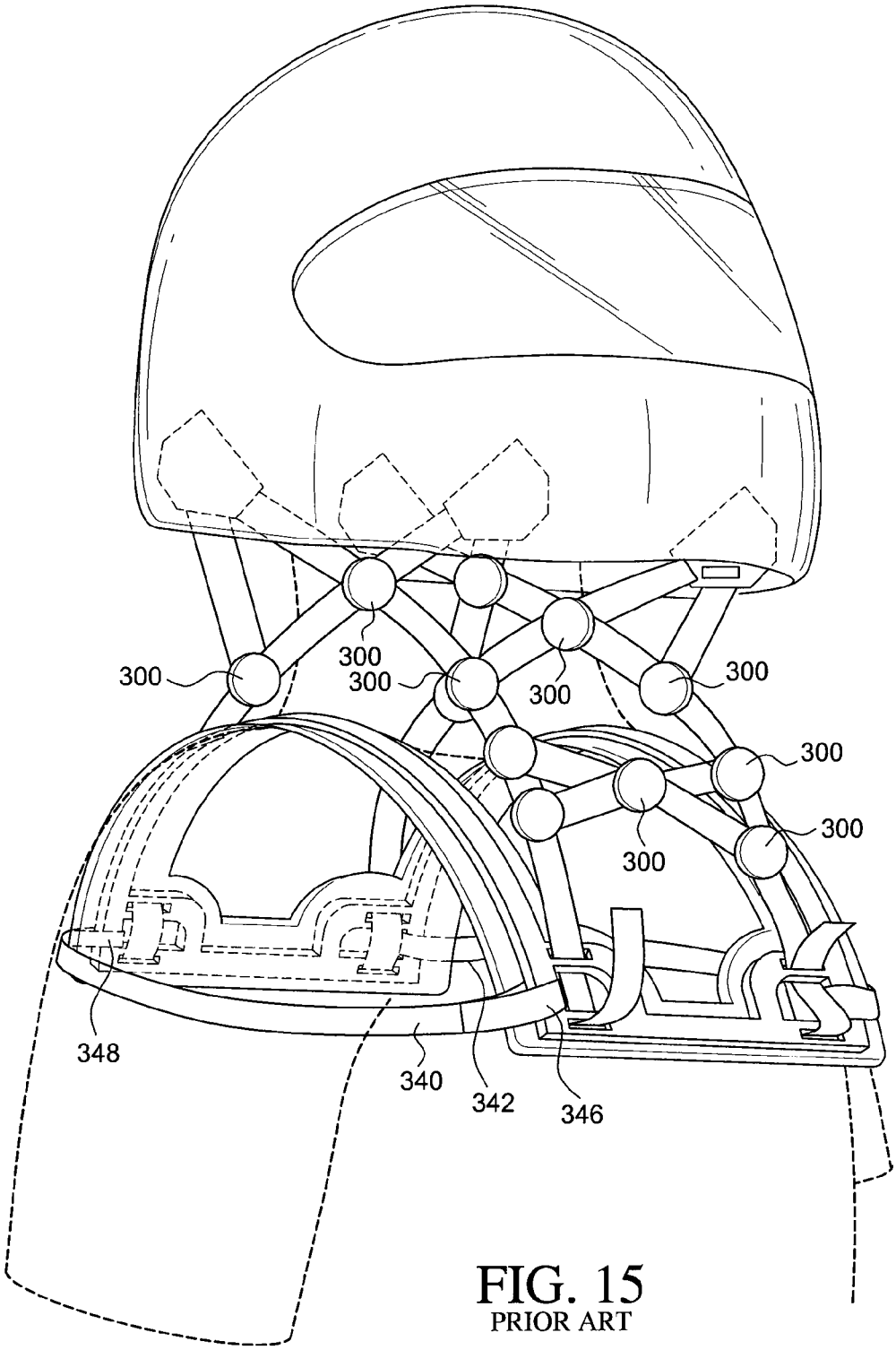
FIG. 15 PRIOR ART
FIG. 15 is a perspective view of the neck restraint system in accordance with one of my earlier patents and including a shoulder support member which may be incorporated in the present invention.
Figure 16:
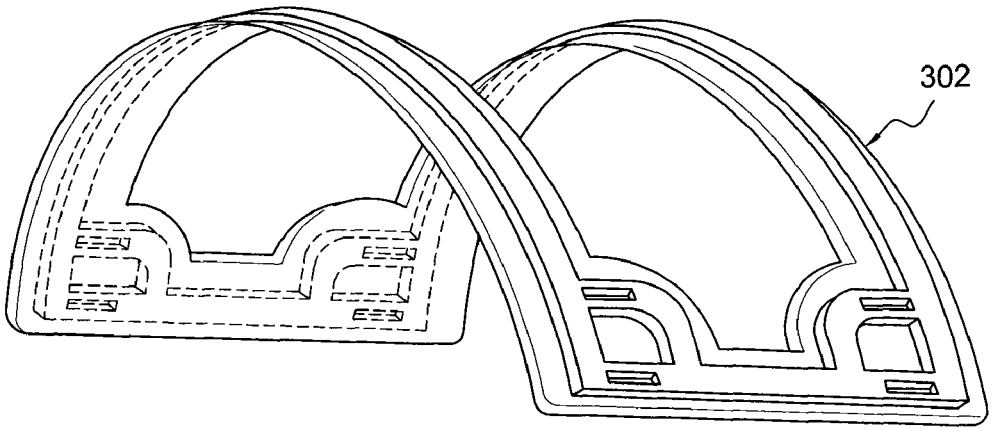
FIG. 16 is a perspective view of a shoulder support arc shown in FIG. 15 in an assembled configuration.
Figure 17:
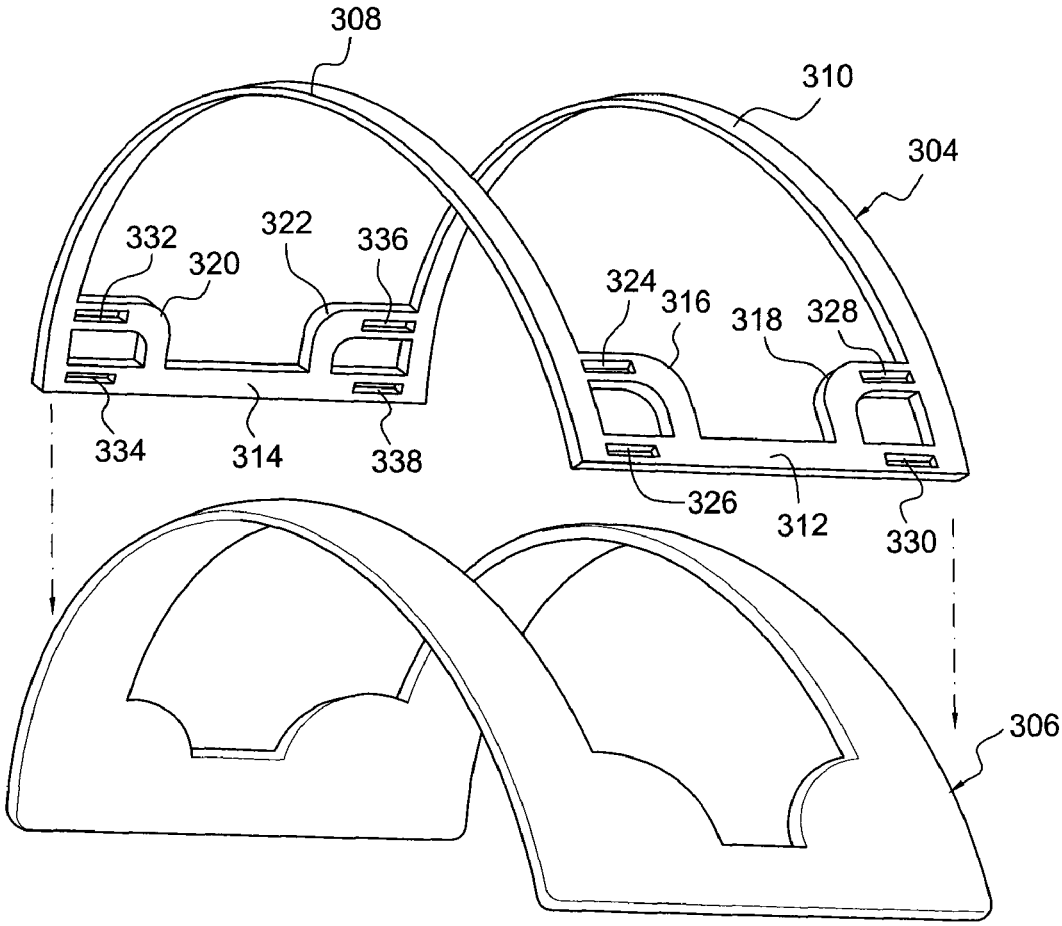
FIG. 17 is an exploded view of the shoulder support arc shown in FIG. 16.

Referring now to FIGS. 15 through 17 the neck restraint system includes a plurality of attaching knobs 300, wherein each knob 300 provides a securing means for replacing the stitching means for attaching the crossover or adjoining straps of the other embodiments. Each knob 300 may be of a snap fit configuration, or in the alternative, may have a sliding feature for allowing the length of the straps to adjust to a user's size.

A shoulder support arc 302 is alternatively provided to replace other means of securing the neck restraint system on the user such as attaching the restraint system to the user's race suit of providing leg anchors. The shoulder support arc 302 includes a first rigid arc portion 304 preferably made from, but not limited to, Kevlar or carbon fiber, and a foam portion 306 having the same shape and configuration as the rigid arc portion 304 which is attached to the underside of the first rigid arc portion 304 by securing means, such as, but not limited to, glue. The rigid arc portion 304 includes a semi-circular first side 308 and an opposing second semi-circular second side 310, which are attached together with an elongate front extension 312 and an elongate rear extension 314.

A first anchor strap 316 is provided at the adjoining corner of the first side 308 and the elongate front extension 312, a second anchor strap 318 is provided at the adjoining corner of the second side 310 and the elongate front extension 312, a third anchor strap 320 is provided at the adjoining corner of the first side 308 and the elongate rear extension 314, and a fourth anchor strap 322 is provided at the adjoining corner of the second side 310 and the elongate rear extension 314. The first anchor strap 316 includes a first slot 324 and a second slot 326 for receiving the strap and securing it to the shoulder support arc 302. Similarly, the second anchor strap 318 includes a first slot 328 and second slot 330, the third anchor strap 320 includes a first slot 332 and a second slot 334, and the fourth anchor strap 322 includes a first slot 326 and a second slot 338. The shoulder support arc 302 is placed over the user's shoulders and secured to the body by a first belt 340 extending under the user's armpit, the first end 346 of which is attached to the first anchor strap 316 and the second end 348 is attached to the third anchor strap 320. Similarly, a second belt 342 includes a first end 350 attached to the second anchor strap 318 and a second end 352 attached to the fourth anchor strap 322.

Referring now to FIGS. 18 through 22 the first, second, third, and fourth anchor straps 316, 318, 320, and 322 are replaced with a first, a second, a third, and fourth recoil anchoring means 354, 356, 358, and 360. Each recoil anchoring means includes a dome-shaped housing 362 and an aperture 364 through which the strap belt extend outwardly. A recoil mechanism 366 is housed within the dome-shaped housing 362, wherein the recoil mechanism 366 functions to adjust the extendible length of the strap belt as well as locking the strap belt at a certain desired length.

The first and the second sides 308 and 310 each includes an adjusting means generally shown at 368. The first side 308 includes a front half portion 370 and a rear half portion 372 pivotally connected to the front half portion 370 by the adjusting means 368. More specifically, the front half portion 370 includes a plurality of substantially circular retaining means 374 attached for a peripheral edge thereof wherein each circular retaining means 374 is divided by a space 376 from the adjoining circular retaining means 374. Similarly, the rear half portion 372 includes a plurality of substantially circular retaining means 378 attached to a peripheral edge thereof and in a facing relation to the plurality of circular retaining means 374, wherein each circular retaining means 374 is divided by a space 380 from the adjoining circular retaining means 378.

Figures 20, 21, 22:
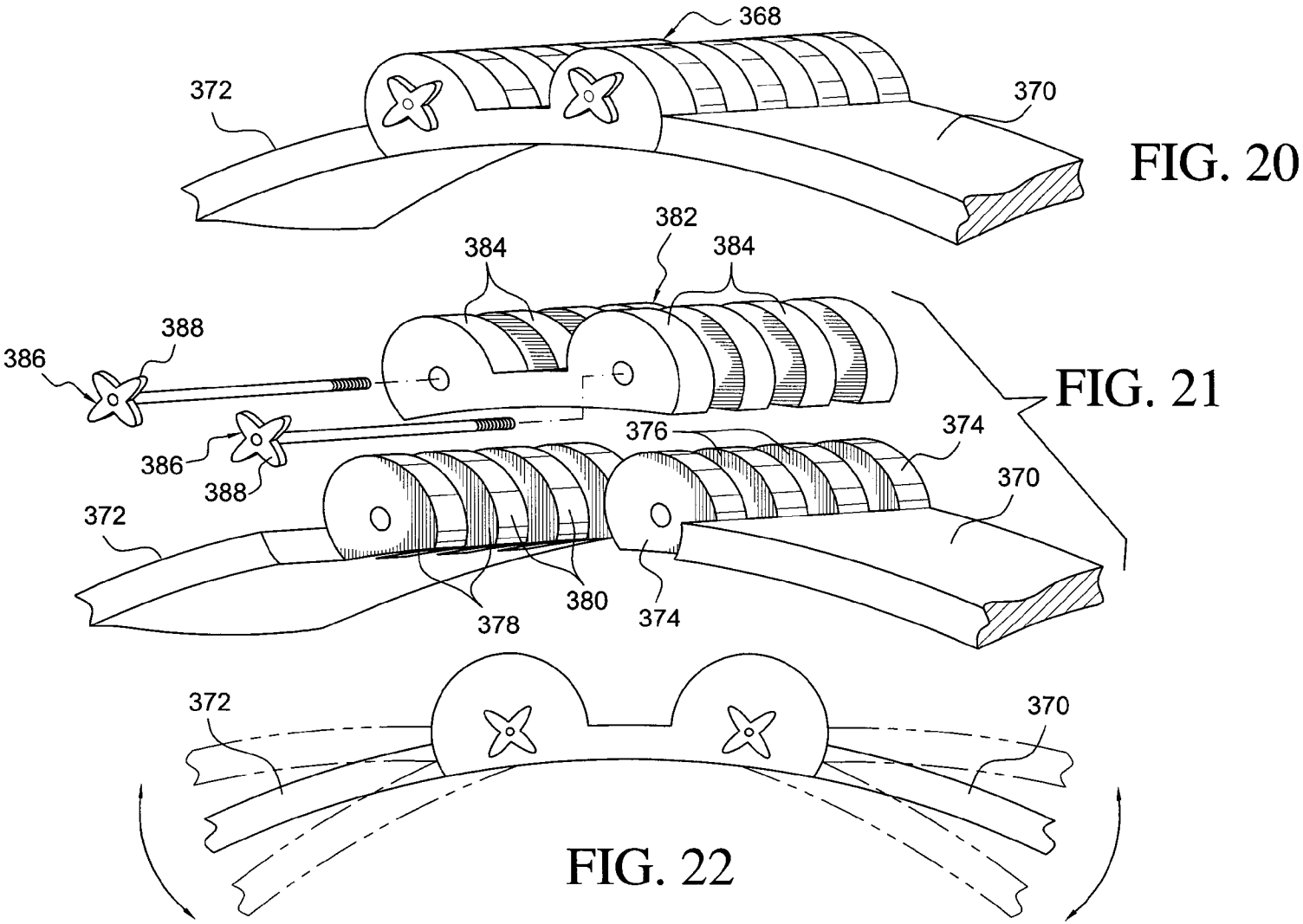
FIG. 20 is a perspective of a shoulder size adjusting means in an assembled configuration.
FIG. 21 is an exploded view of the shoulder size adjusting means shown in FIG. 20.
FIG. 22 is a side sectional view of the should size adjusting means shown in FIG. 20.

A link 382 having a plurality of opposing circular retaining means 384 with a plurality of spaces 386 is provided and includes a shaped and configuration so that each circular retaining means 384 may be received within the corresponding space between the adjoining circular retaining means 374 on one side, and on the opposite side, each circular retaining means may be received within the corresponding space between the adjoining circular retaining means 378. The link 382 pivotally attaches the first half portion 370 to the second half portion 372 with a pair of elongated screws 386 each having a knob 388 at one end thereof, wherein the first half portion 370 and the second half portion 372 may be adjusted in a clockwise or counter clockwise motion, as best seen in FIG. 22, to adjust to the curvature and size of the user's shoulder, and then secured in that desired position by tightening the screws 386.

An improved head and neck restraint system in accordance with a preferred embodiment of the present invention will now be described in connection with FIGS. 23-30. As shown therein the head and neck restraint system 400 includes a helmet, sometimes referred to a head shell 410 that surrounds an individual's head, forehead and chin with a hard outer shell and a foam lining as for example, polyurethane as approved by the major racing organizations. The helmet includes an opening in a bottom portion through which an individual inserts his or her head on a conventional manner. The helmet or head shell 410 also includes a face portion 412.

Figure 24:
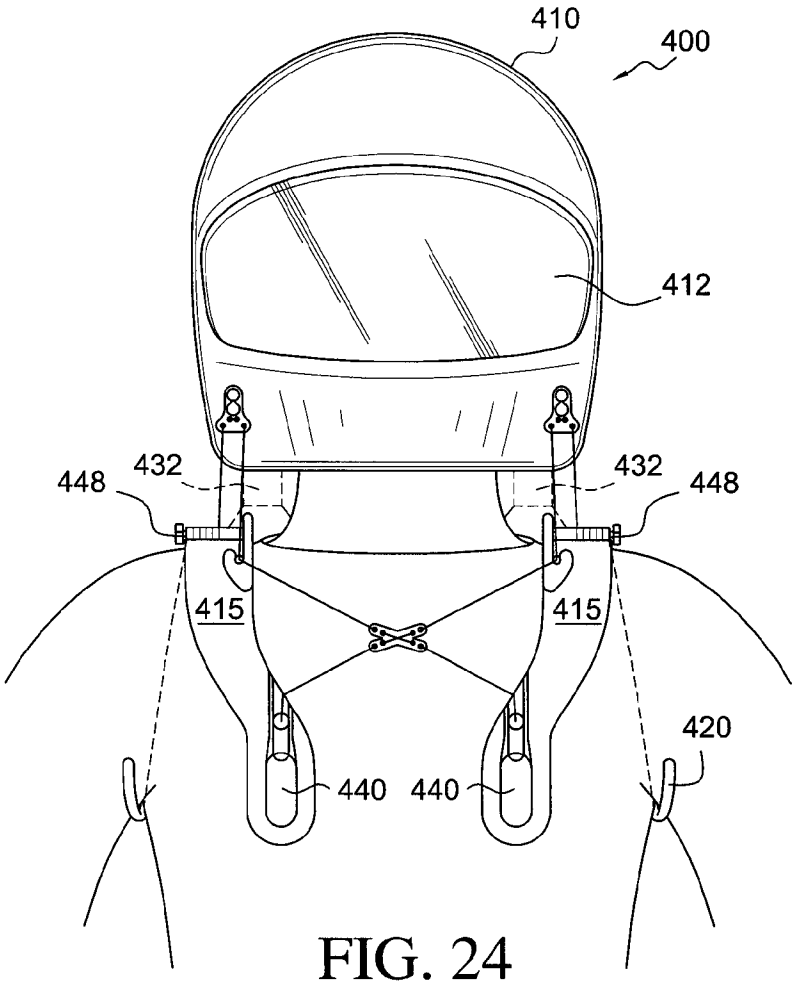
FIG. 24 is a front elevational view of the head and neck restraint system shown in FIG. 23.
Figure 23:
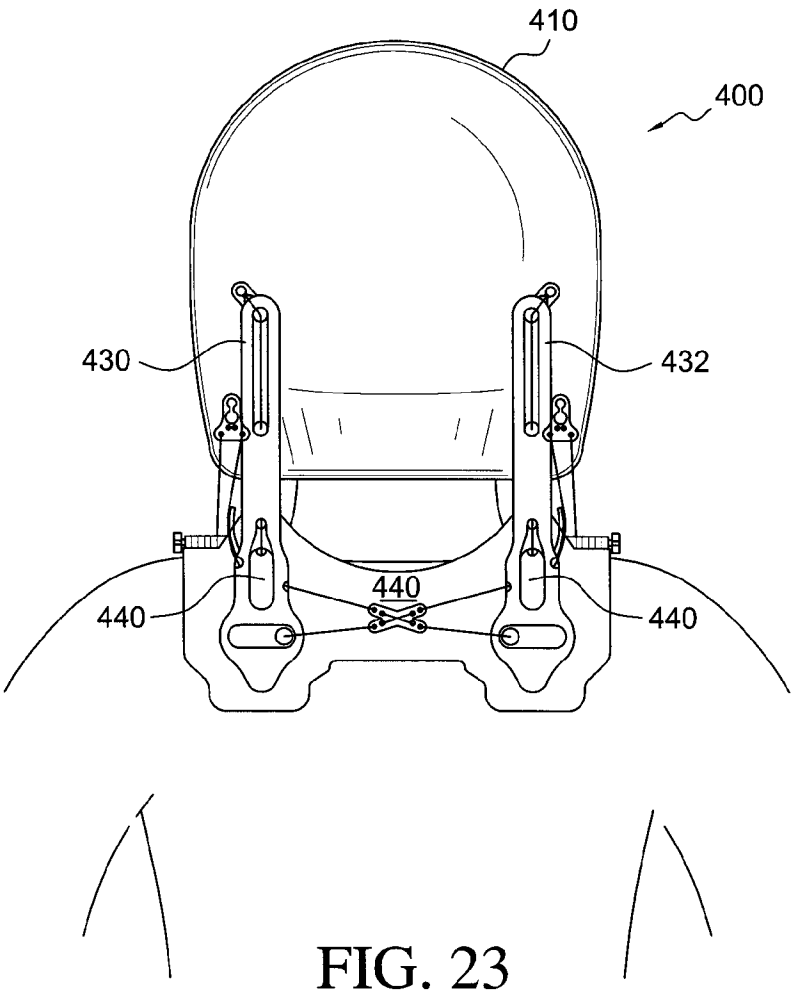
FIG. 23 is a rear elevational view of a head and neck restraint system in accordance with a preferred embodiment of the present invention.
Figure 26:
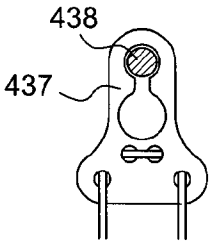
FIG. 26 is a plan view of a joining element and strap director as used in one embodiment of the invention.
Figure 27:
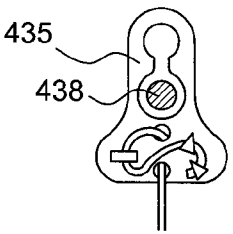
FIG. 27 is a plan view of a strap director and tie as used in another embodiment of the present invention.
Figure 28:
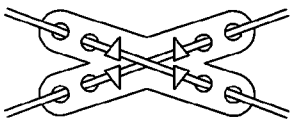
FIG. 28 is a plan view of a generally X-cross joiner and strap director in accordance with one embodiment of the invention.
Figure 29:
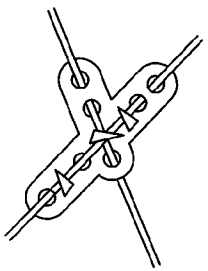
FIG. 29 is a joiner and strap director having a screwed strap director in accordance with another embodiment of the invention.
Figure 25:
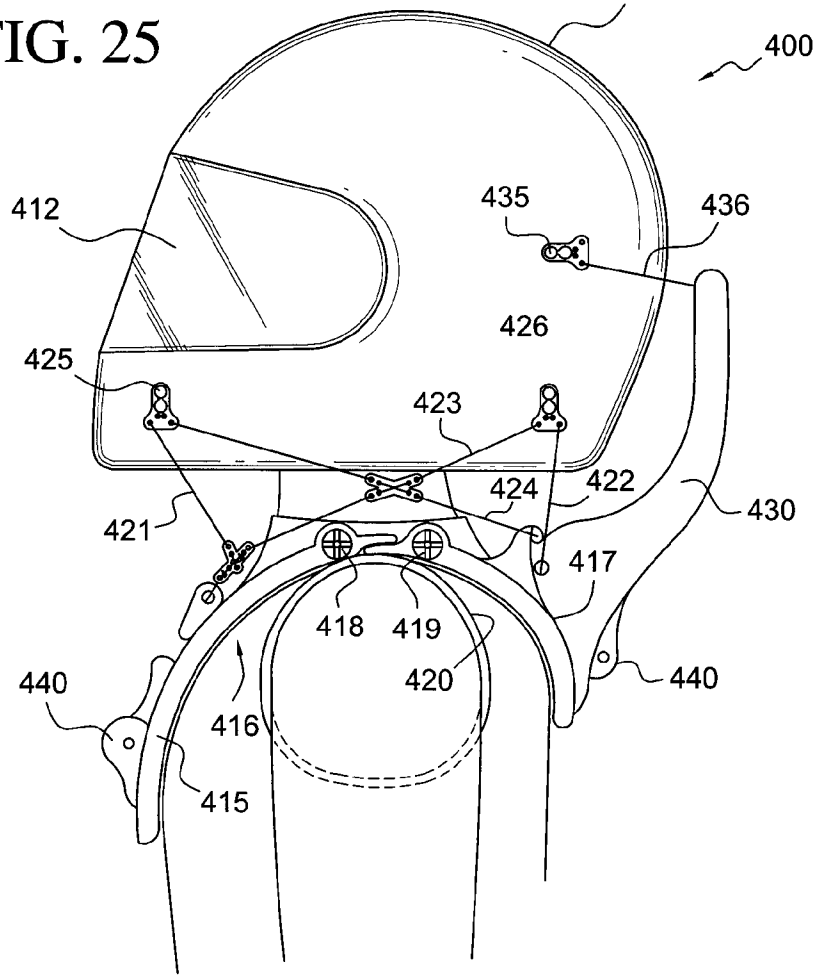
FIG. 25 is a side elevational view of the head and neck restraint system shown in FIGS. 23 and 24.
Figure 31:
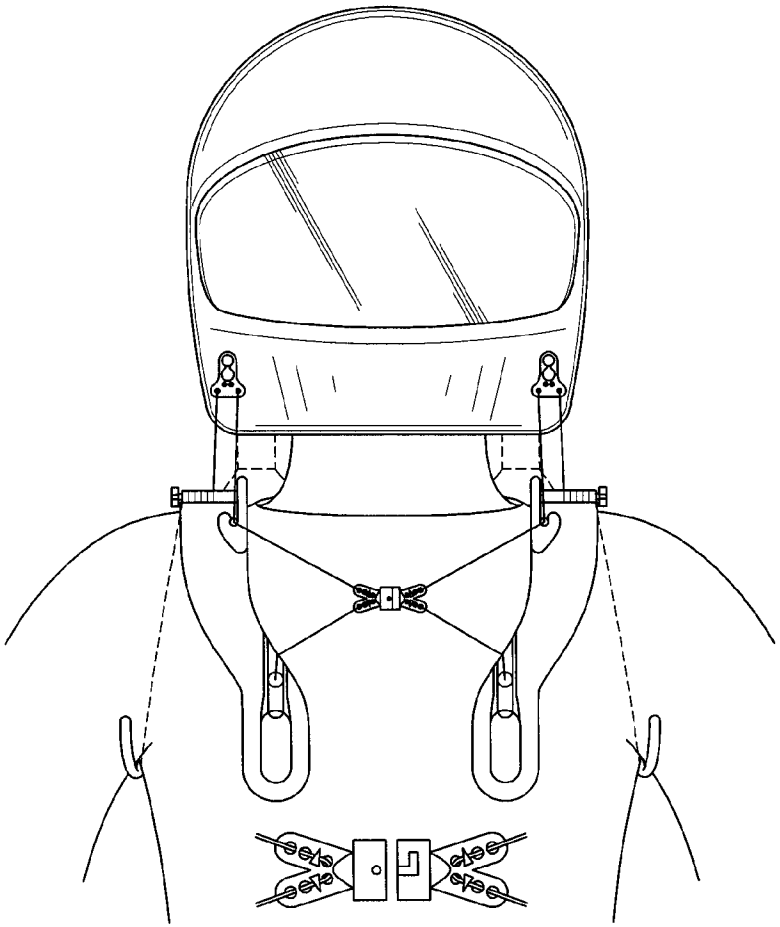
FIG. 31 is a front elevational view of the head and neck restraint system shown in FIG. 24 but showing a fastener in an opened position.
Figure 30:
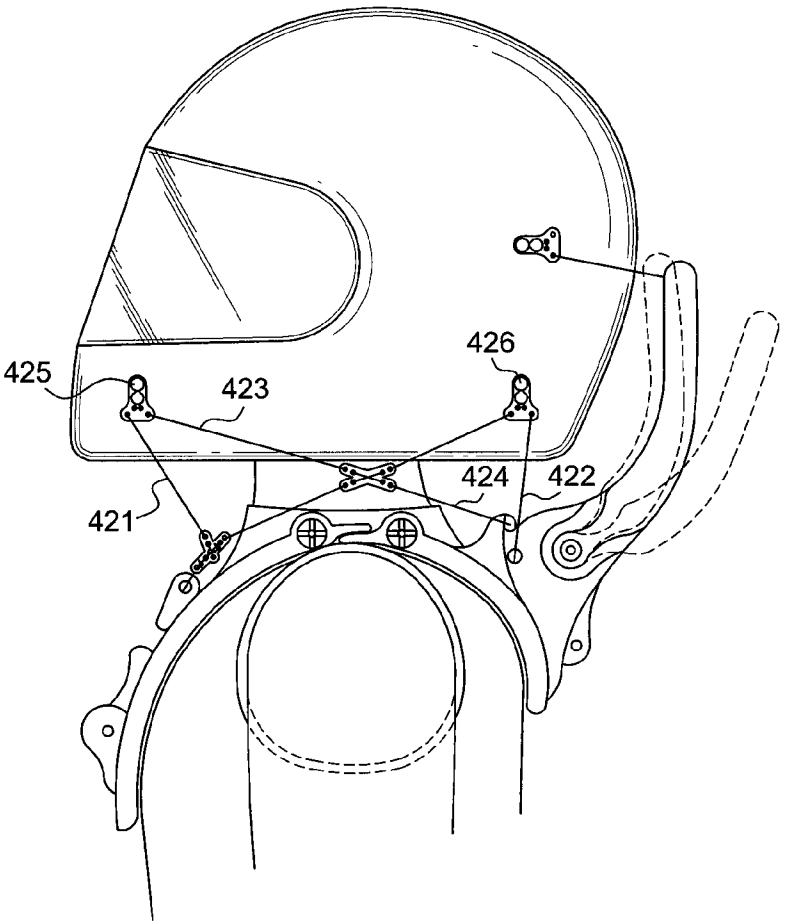
FIG. 30 is a schematic illustration of a locking mechanism for positioning the upwardly extending support member.

The head and neck restraint system 400 also includes an arch-shaped shoulder mounted support 414 that rests on the shoulders of an individual and may take a form as shown in FIGS. 15-18. As shown in FIGS. 23-25 an arch-shaped shoulder mounted support member 416 includes a front portion 415 and rear portion 417 that are connected by one or two pivots 418 and 419 that provide adjustment of the curvature in order to fit an individual.

Means such as a semi-ridged strap 420 pass under the arms of the individual and are fixed to one or both of the front and rear portions 415 and 417 for firmly maintaining the arch-shaped shoulder mounted member 416 on the shoulders of the individual. The head and neck restraint system also includes one or more flexible connectors or straps 421, 422, 423 and 424 on each side of the head restraint system to connect a forward lower portion and a rear lower portion 425 and 426 to the front and rear portions 415 and 417 of the arch-shaped shoulder mounted support member 416. The straps 421, 422, 423 and 424 can be combined in a single end of strap that forms an X-shaped configuration at a director plate 427.

The system 420 also includes a pair of upwardly extending restraint members or towers 430 and 432 as shown most clearly in FIG. 23. The restraint members or towers 430 and 432 extend upwardly from the rear portion 417 of the arch-shaped shoulder mounted support 414 behind the head shell 410 and are attached to the rear portion 417. The upwardly extending towers 430 and 432 may be made of carbon/carbon fiber compounds or other suitable material as will be well understood by those of ordinary skill in the art and/or integrally formed with the rear portion of the arch-shaped shoulder mounted member 416.

The upwardly extending restraint members or towers 430 and 432 are each tethered to one side i.e. the left side and the right side of the head shell 40 by means of a pair of fasteners 435 and 437 (see FIGS. 25-27) and a pair of tethers 436. The fasteners 435 and 437 may be of various designs and may engage a pair outwardly projecting rods 438 with one of the rods 438 on each side of the rear portion of the head shell.

Additional features of the present invention include a belt extender 440 as shown in FIGS. 23, 24 and 25. The belt extender includes a mechanism which is similar if not identical to the mechanism used in safety belts and shoulder belts in automobiles and includes a locking mechanism as will be well understood by persons of ordinary skill in the art. In addition, the towers, 430, 432 may be adjustable along a horizontal axis by means of a slot 445 with conventional clamp means as will once again be well understood by persons of ordinary skill in the art.

The towers 430, 432 may also include an adjustment mechanism to move the upwardly extending towers backward and forward so that towers are further away or closer to the helmet as shown in FIG. 25. For example, limited movement about a pivot are provided after adjustment a conventional locking release button 448 is pressed to lock the towers in place.

A further feature of the head and neck restraint system in accordance with the present invention incorporates a X-directional joiner with a fastening mechanism 450 that directs a front belt in a cross like configuration but allows the two sides of the X to be separated for ease in removing the system from an individual rider. It is also contemplated that the flexible connectors or straps can extend along or through the front and rear portion of the arch-shaped shoulder mounted member.

While the invention has been described in connection with its preferred embodiment, it should be recognized that changes and modifications may be made therein without departing from the scope of the appended claims.

What is claimed is:

1. A head and neck restraint system for protecting the neck of an individual during a crash of a motor vehicle, said head and neck restraint system comprising:

a head shell surrounding the head, forehead and chin of an individual with a bottom portion, a face portion, an opening in said bottom portion and a forward lower and rear lower connecting portion on each side thereof;

an arch-shaped shoulder mounted support member comprising a front portion resting on and extending over a forward part of the individual's shoulders and an upper portion of the individual's chest and a rear portion resting on a rear part of the individual's shoulder and an upper portion of the individual's back;

an adjustable mechanism including a pair of parallel hinge assemblies for adjusting the curvature of the arch-shaped shoulder mounted support member and wherein said front portion and said rear portion of said arch-shaped shoulder mounted support member are pivotally connected to one another by said pair of parallel hinge assemblies;

means passing at least partially under the individual's arms fixed to said arch-shaped shoulder mounted support member for maintaining said arch-shaped shoulder mounted support member on the shoulders of the individual;

first and second flexible connecting means for connecting said forward lower and rear lower connecting points on each side of said head shell to said front portion and said rear portion of said arch-shaped shoulder mounted support member and wherein each of said flexible connecting means form an X-patter configuration on a right side and a left side of the individual below the helmet;

a pair of adjustable upwardly extending restraint members that extend upwardly behind the head of the individual and above a lower portion of said head shell and third and fourth flexible connecting means with one of said flexible connecting means connecting an upper side of said head shell to one of said upwardly extending restraint members and the other of said third and fourth flexible connecting means connecting an upper side of the other side of said head shell to the other of said upwardly extending restraint members whereby the upwardly extending restraint members prevent forward movement of the individual's head as a result of a crash and wherein said upwardly extending restraint members also limit rearward movement of the individual's head to prevent whiplash or other injury; and, wherein said adjustable upwardly extending restraint members each include a lower portion fixed to said rear portion of said arch-shaped shoulder support member, a pivot and an upper portion connected to said lower portion by said pivot and a lock assembly for fixing said upper portion at a fixed distance from said head shell.

2. A head and neck restraint system for protecting the neck of an individual during a crash of a motor vehicle according to claim 1 which includes a pair of recoil mechanisms for adjusting extendable, retractable and locked connecting straps between each of said upper portions of said upwardly extending restraint member.

3. A head and neck restraint system for protecting the neck of an individual during a crash according to claim 1 in which said flexible connecting means comprise a belt, strap or cord.

4. A head and neck restraint system for protecting the neck of an individual during a crash of a motor vehicle according to claim 1 in which said adjustable upwardly extending restraint member each include a lower portion fixed to said rear portion of said arch-shaped shoulder support member, a pivot and an upper portion connected to said lower portion by said pivot and a lock assembly for fixing said upper portion at a fixed distance from said head shell.

5. A head and neck restraint system for protecting the neck of an individual during a crash of a motor vehicle, said head and neck restraint system consisting of:

a head shell surrounding the head, forehead and chin of an individual with a bottom portion, a face portion, an opening in said bottom portion and a forward lower and rear lower connecting portion on each side thereof;

an arch-shaped shoulder mounted support member comprising a front portion resting on and extending over a forward part of the individual's shoulders and an upper portion of the individual's chest and a rear portion resting on a rear part of the individual's shoulder and an upper portion of the individual's back;

an adjustable mechanism including a pair of parallel hinge assemblies for adjusting for adjusting the curvature of the arch-shaped shoulder mounted support member and wherein said front portion and said rear portion of said arch-shaped shoulder mounted support member are pivotally connected to one another by said pair of parallel hinge assemblies;

means passing at least partially under the individual's arms fixed to said arch-shaped shoulder mounted support member for maintaining said arch-shaped shoulder mounted support member on the shoulders of the individual;

first and second flexible connecting means for connecting said forward lower and rear lower connecting points on each side of said head shell to said front portion and said rear portion of said arch-shaped shoulder mounted support member and wherein each of said flexible connecting means form an X-patter configuration on a right side and a left side of the individual below the helmet;

a pair of adjustable upwardly extending restraint members that extend upwardly behind the head of the individual and above a lower portion of said head shell and third and fourth flexible connecting means with one of said flexible connecting means connecting an upper side of said head shell to one of said upwardly extending restraint members and the other of said third and fourth flexible connecting means connecting an upper side of the other side of said head shell to the other of said upwardly extending restraint members whereby the upwardly extending restraint members prevent forward movement of the individual's head as a result of a crash and wherein said upwardly extending restraint members also limit rearward movement of the individual's head to prevent whiplash or other injury.

* * * * *